US012768022B2

(12) United States Patent
Kochi et al.

(10) Patent No.: US 12,768,022 B2
(45) Date of Patent: Oct. 20, 2026

(54) AUSTENITIC STAINLESS STEEL MATERIAL

(71) Applicant: NIPPON STEEL CORPORATION, Tokyo (JP)

(72) Inventors: Norifumi Kochi, Tokyo (JP); Kiyoko Takeda, Tokyo (JP); Takahiro Osuki, Tokyo (JP); Shinnosuke Kurihara, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 18/843,481

(22) PCT Filed: Mar. 11, 2022

(86) PCT No.: PCT/JP2022/010934

§ 371 (c)(1),
(2) Date: Sep. 3, 2024

(87) PCT Pub. No.: WO2023/170935

PCT Pub. Date: Sep. 14, 2023

(65) Prior Publication Data

US 2025/0197982 A1 Jun. 19, 2025

(51) Int. Cl.
*C22C 38/58* (2006.01)
*C21D 9/46* (2006.01)
(Continued)

(52) U.S. Cl.
CPC ..... *C22C 38/58* (2013.01); *C21D 9/46* (2013.01); *C22C 38/001* (2013.01); *C22C 38/002* (2013.01); *C22C 38/004* (2013.01); *C22C 38/005* (2013.01); *C22C 38/02* (2013.01); *C22C 38/04* (2013.01); *C22C 38/06* (2013.01);
(Continued)

(58) Field of Classification Search
None
See application file for complete search history.

(56) References Cited

U.S. PATENT DOCUMENTS

2019/0177808 A1* 6/2019 Kurihara ..... C22C 38/02
2022/0259688 A1 8/2022 Osuki et al.

FOREIGN PATENT DOCUMENTS

JP 2021021093 A 2/2021
JP 2021066928 A 4/2021
WO 2021015283 A1 1/2021

* cited by examiner

*Primary Examiner* — Daniel J. Schleis
(74) *Attorney, Agent, or Firm* — Greer, Burns & Crain, Ltd.

(57) ABSTRACT

An austenitic stainless steel material according to the present disclosure contains, in mass %, C: 0.030% or less, Si: 0.01 to 1.00%, Mn: 0.01 to 2.00%, P: 0.040% or less, S: 0.0100% or less, Ni: 8.00 to 18.00%, Cr: 15.00 to 25.00%, Mo: 0.10 to 5.00%, Nb: 0.20 to 1.00%, N: 0.060 to 0.250%, Cu: more than 2.00 to 4.00%, and B: 0.0010 to 0.0100%, and satisfies Formula (1):

$$Nbs \times 0.8 > Nbb \quad (1)$$

where, in Formula (1), an average Nb concentration in percent by mass in an outer layer from a surface of the austenitic stainless steel material to a depth of 10 μm is substituted for Nbs, and an average Nb concentration in percent by mass in a region excluding the outer layer of the austenitic stainless steel material is substituted for Nbb.

4 Claims, 1 Drawing Sheet

F 2

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |

(52) U.S. Cl.

CPC ..... *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C21D 2211/001* (2013.01)

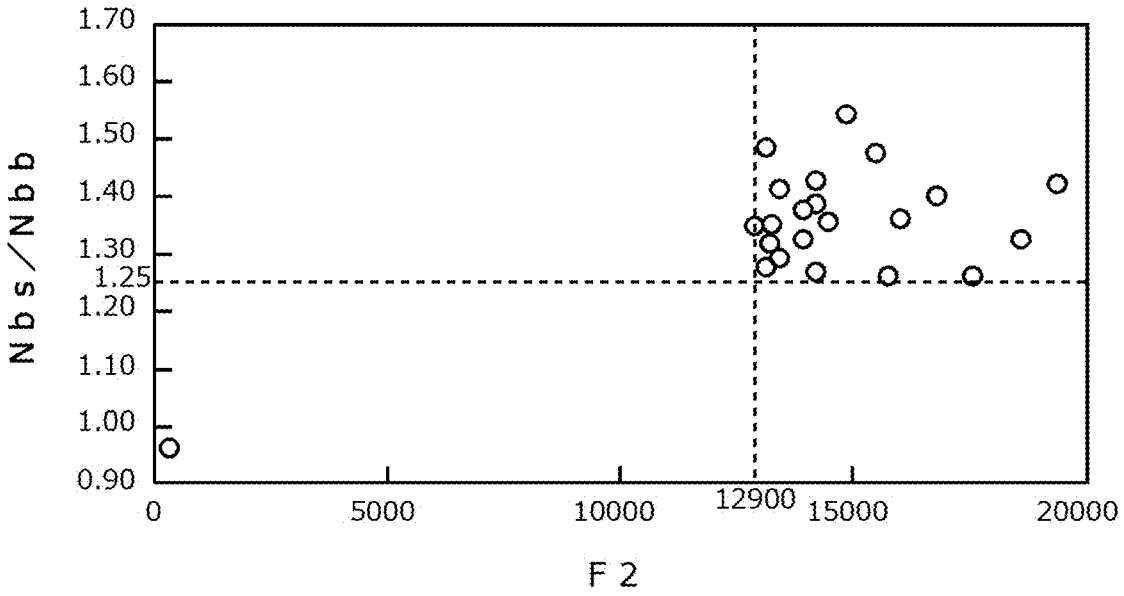
1.70
1.60
1.50
1.40
1.30
1.25
1.20
1.10
1.00
0.90
Nbs／Nbb
0
5000
10000
12900
15000
20000
F 2

AUSTENITIC STAINLESS STEEL MATERIAL

TECHNICAL FIELD

The present disclosure relates to a steel material, and more particularly relates to an austenitic stainless steel material.

BACKGROUND ART

A steel material that is used in chemical plant facilities such as an oil refinery plant or a petrochemical plant is required to have high temperature strength. Austenitic stainless steel materials are used as steel materials for use in these chemical plant facilities.

A chemical plant facility includes multiple apparatuses. The apparatuses provided in a chemical plant facility are, for example, a vacuum distillation unit, a direct desulfurization unit, a catalytic reforming unit and the like. These apparatuses include a heating furnace pipe, a reactor, a tank, a heat exchanger, piping and the like. Austenitic stainless steel materials are used for these apparatuses in consideration of strength in a high temperature environment, corrosion resistance, workability, economic efficiency and the like.

In petrochemical plants, in some cases a process is performed in which residual coke obtained after reforming petroleum that is the raw material is further subjected to a reforming treatment to produce product gas. A plant that performs this process is referred to as a "delayed coker".

The average temperatures during operation of the respective apparatuses differ from each other. Hereinafter, the average temperature during operation is referred to as "average operating temperature". For example, the average operating temperature of a vacuum distillation unit is 400 to 450° C. The average operating temperature of a direct desulfurization unit is 400 to 450° C. The average operating temperature of a catalytic reforming unit is 420 to 600° C. Therefore, an austenitic stainless steel material that is used for a heating furnace pipe, a reactor, a tank, a heat exchanger, piping or the like in these apparatuses is held for a long time period at an average operating temperature within a range of around 400 to 600° C. Among the apparatuses of some chemical plant facilities, which are typified by catalytic reforming units that include delayed cokers, there are also apparatuses whose average operating temperature ranges from 650 to 750° C. and whose design maximum tolerance temperature is 815° C.

Austenitic stainless steel materials that can be used in chemical plants with an average operating temperature of 650° C. or more are proposed in, for example, Japanese Patent Application Publication No. 2021-021093 (Patent Literature 1) and Japanese Patent Application Publication No. 2021-066928 (Patent Literature 2).

Patent Literature 1 discloses an austenitic stainless steel material that consists of, in mass %, C: 0.030% or less, Si: 1.00% or less, Mn: 2.00% or less, P: 0.040% or less, S: 0.0100% or less, Cr: 15.00 to 25.00%, Ni: 8.00 to 18.00%, Mo: 0.10 to 5.00%, Cu: more than 2.00 to 4.00%, N: 0.06 to 0.25%, Nb: 0.2 to 1.0%, B: 0.0010 to 0.0100%, Ti: 0 to 0.50%, Ta: 0 to 0.50%, V: 0 to 1.00%, Zr: 0 to 0.10%, Hf: 0 to 0.10%, Co: 0 to 1.00%, W: 0 to 5.00%, sol. Al: 0 to 0.100%, Ca: 0 to 0.0200%, Mg: 0 to 0.0200%, rare earth metal: 0 to 0.100%, Sn: 0 to 0.010%, As: 0 to 0.010%, Zn: 0 to 0.010%, Pb: 0 to 0.010%, and Sb: 0 to 0.010%, with the balance being Fe and impurities, and that satisfies Formula (1) and Formula (2), and in which the content of Nb in a residue obtained by an extraction residue method is 0.052% by mass or more, and the content of Cr in the residue is 0.245% by mass or less:

$$0 \le B + 0.21\ Mo - 1.9C \le 0.220 \quad (1)$$

$$8.8 \le Ni + 0.05\ Cu - 0.1 \times (Mo)^2 \le 13.2 \quad (2)$$

where, a content (mass %) of a corresponding element in the chemical composition is substituted for each symbol of an element in Formula (1) and Formula (2).

According to Patent Literature 1, by satisfying Formulae (1) and (2), a sensitization property and the stress relaxation cracking resistance of the austenitic stainless steel material are increased.

Patent Literature 2 discloses an austenitic stainless steel material that consists of, in mass %, C: 0.030% or less, Si: 0.10 to 1.00%, Mn: 0.2 to 2.0%, P: 0.01 to 0.04%, S: 0.0100% or less, Cr: 15.00 to 25.00%, Ni: 9.00 to 18.00%, Mo: 1.0 to 5.0%, Nb: 0.20 to 2.00%, N: 0.050 to 0.180%, sol. Al: 0.001 to 0.080%, B: 0.0005 to 0.0080%, Cu: 0 to 2.00%, V: 0 to 1.00%, Co: 0 to 1.0%, Y: 0 to 1.00%, Zr: 0 to 1.0%, Hf: 0 to 0.20%, Ta: 0 to 0.20%, W: 0 to 5.0%, Ca: 0 to 0.0100%, Mg: 0 to 0.0100%, and rare earth metals other than Y: 0 to 0.100%, with the balance being Fe and impurities, and in which the grain size number is 4.0 to 9.0, and when the B concentration (mass %) at austenite grain boundaries in the austenitic stainless steel material is defined as $[B_{GB}]$, and the B concentration (mass %) within the austenite grains is defined as $[B_{BM}]$, the austenitic stainless steel material satisfies Formula (1).

$$[B_{GB}]/[B_{BM}] \ge 500 \quad (1)$$

According to Patent Literature 2, by satisfying Formula (1) the grain boundary strength is increased, and the creep strength and the creep ductility of the austenitic stainless steel material in a high temperature environment are increased.

CITATION LIST

Patent Literature

Patent Literature 1: Japanese Patent Application Publication No. 2021-021093

Patent Literature 2: Japanese Patent Application Publication No. 2021-066928

SUMMARY OF INVENTION

Technical Problem

In this connection, at an average operating temperature of 650° C. or more, carbon contained in petroleum that is the raw material or in residual coke penetrates into the austenitic stainless steel material inside the relevant apparatus, and carburizing occurs. Carbides excessively form inside the austenitic stainless steel material due to the carburizing. As a result, the ductility of the austenitic stainless steel material significantly decreases. Therefore, austenitic stainless steel materials are required to have excellent carburization resistance.

In Patent Literature 1 and Patent Literature 2, carburizing in a high temperature environment of 650° C. or more is not investigated. Therefore, in the austenitic stainless steel materials disclosed in Patent Literature 1 and Patent Literature 2, in some cases carburizing in a high temperature environment of 650° C. or more cannot be suppressed.

An objective of the present disclosure is to provide an austenitic stainless steel material that has excellent carburization resistance even in a high temperature environment of 650° C. or more.

Solution to Problem

An austenitic stainless steel material according to the present disclosure consists of, in mass %, C: 0.030% or less,
Si: 0.01 to 1.00%,
Mn: 0.01 to 2.00%,
P: 0.040% or less,
S: 0.0100% or less,
Ni: 8.00 to 18.00%,
Cr: 15.00 to 25.00%,
Mo: 0.10 to 5.00%,
Nb: 0.20 to 1.00%,
N: 0.060 to 0.250%,
Cu: more than 2.00 to 4.00%,
B: 0.0010 to 0.0100%,
sol. Al: 0 to 0.100%,
Co: 0 to 1.00%,
W: 0 to 5.00%,
V: 0 to 1.00%,
Ti: 0 to 0.50%,
Ta: 0 to 0.50%,
Hf: 0 to 0.10%,
Zr: 0 to 0.10%,
Ca: 0 to 0.0200%,
Mg: 0 to 0.0200%, and
rare earth metal: 0 to 0.100%,
with the balance being Fe and impurities,
and satisfies Formula (1):

$$Nbs \times 0.8 > Nbb \quad (1)$$

where, in Formula (1), an average Nb concentration in percent by mass in an outer layer from a surface of the austenitic stainless steel material to a depth of 10 μm is substituted for Nbs, and an average Nb concentration in percent by mass in a region excluding the outer layer of the austenitic stainless steel material is substituted for Nbb.

Advantageous Effect of Invention

The austenitic stainless steel material of the present disclosure has excellent carburization resistance even in a high temperature environment of 650° C. or more.

BRIEF DESCRIPTION OF DRAWING

FIG. 1 is a graph illustrating the relation between the conditions of a solution treatment and the concentration of Nb in an outer layer of an austenitic stainless steel material.

DESCRIPTION OF EMBODIMENTS

The present inventors conducted studies and investigations regarding an austenitic stainless steel material that has excellent carburization resistance even in a high temperature environment of 650° C. or more. As a result, the present inventors obtained the following findings.

When carburization resistance in a high temperature environment of 650° C. or more is to be increased, it is effective to form a coating containing $Cr_2O_3$ on the austenitic stainless steel material surface during use of the austenitic stainless steel material in a high temperature environment of 650° C. or more. In order to uniformly form a coating containing $Cr_2O_3$ on the surface of an austenitic stainless steel material during use in a high temperature environment of 650° C. or more, it is effective to facilitate the diffusion of Cr in the austenitic stainless steel material to the surface in a high temperature environment of 650° C. or more.

Among the elements contained in an austenitic stainless steel material, Cr mainly diffuses preferentially through grain boundaries. Since it is easy for Cr that is present in the vicinity of grain boundaries to diffuse by passing through the grain boundaries, it is effective to maintain the Cr concentration in the vicinity of grain boundaries so that the Cr concentration does not decrease.

On the other hand, in a high temperature environment of 650° C. or more, Cr combines with C in the austenitic stainless steel material to form Cr carbides at grain boundaries. At such time, since Cr in the vicinity of the grain boundaries is consumed as Cr carbides, if grain boundary Cr carbides are formed, the Cr concentration in the vicinity of the grain boundaries will decrease. Here, Cr carbides are formed not only by C that penetrated into the austenitic stainless steel material from outside, but also by C that is originally contained in the austenitic stainless steel material. Therefore, in order to suppress a decrease in the Cr concentration in the vicinity of the grain boundaries, it is effective to reduce the content of C in the austenitic stainless steel material.

The present inventors considered that by reducing the content of C in an austenitic stainless steel material, a coating containing $Cr_2O_3$ will be uniformly formed, and by this means, the carburization resistance of the austenitic stainless steel material will be increased. Therefore, the present inventors conducted studies regarding the chemical composition of an austenitic stainless steel material in which the content of C is reduced. As a result, the present inventors discovered that a chemical composition consisting of, in mass %, C: 0.030% or less, Si: 0.01 to 1.00%, Mn: 0.01 to 2.00%, P: 0.040% or less, S: 0.0100% or less, Ni: 8.00 to 18.00%, Cr: 15.00 to 25.00%, Mo: 0.10 to 5.00%, Nb: 0.20 to 1.00%, N: 0.060 to 0.250%, Cu: more than 2.00 to 4.00%, B: 0.0010 to 0.0100%, sol. Al: 0 to 0.100%, Co: 0 to 1.00%, W: 0 to 5.00%, V: 0 to 1.00%, Ti: 0 to 0.50%, Ta: 0 to 0.50%, Hf: 0 to 0.10%, Zr: 0 to 0.10%, Ca: 0 to 0.0200%, Mg: 0 to 0.0200%, and rare earth metal: 0 to 0.100%, with the balance being Fe and impurities, is effective.

However, even when austenitic stainless steel materials had the above chemical composition, in some cases sufficient carburization resistance was not obtained in a high temperature environment of 650° C. or more. Therefore, the present inventors conducted further studies regarding methods for increasing the carburization resistance of an austenitic stainless steel material even in a high temperature environment of 650° C. or more.

The present inventors focused their attention on the average Nb concentration in an outer layer of the austenitic stainless steel material, and surmised as follows. If Nb is caused to concentrate in the outer layer of the austenitic stainless steel material, in a high temperature environment of 650° C. or more, Nb carbo-nitrides will form in the vicinity of the surface of the austenitic stainless steel material. By this means, dissolved C in the vicinity of the surface of the austenitic stainless steel material will be consumed, and formation of Cr carbides will be suppressed. If the formation of Cr carbides is suppressed, a decrease in the Cr concentration in the vicinity of the grain boundaries will be suppressed. As a result, it will be easy for Cr in the outer layer of the austenitic stainless steel material to diffuse through the grain boundaries to the surface of the austenitic stainless steel material, and uniform formation of a coating film containing $Cr_2O_3$ will be promoted.

The present inventors conducted further validation studies based on the above inference. As a result, the present inventors discovered that, in an austenitic stainless steel material having the aforementioned chemical composition, it is effective if an average Nb concentration in an outer layer from the surface of the austenitic stainless steel material to a depth of 10 μm and an average Nb concentration in a region excluding the outer layer satisfy Formula (1):

$$Nbs \times 0.8 > Nbb \quad (1)$$

where, in Formula (1), the average Nb concentration in percent by mass in an outer layer from a surface of the austenitic stainless steel material to a depth of 10 μm is substituted for Nbs, and the average Nb concentration in percent by mass in a region excluding the outer layer of the austenitic stainless steel material is substituted for Nbb.

The gist of an austenitic stainless steel material according to the present embodiment, which has been completed based on the above findings, is as follows.

[1]

An austenitic stainless steel material that consists of, in mass %,

C: 0.030% or less,
Si: 0.01 to 1.00%,
Mn: 0.01 to 2.00%,
P: 0.040% or less,
S: 0.0100% or less,
Ni: 8.00 to 18.00%,
Cr: 15.00 to 25.00%,
Mo: 0.10 to 5.00%,
Nb: 0.20 to 1.00%,
N: 0.060 to 0.250%,
Cu: more than 2.00 to 4.00%,
B: 0.0010 to 0.0100%,
sol. Al: 0 to 0.100%,
Co: 0 to 1.00%,
W: 0 to 5.00%,
V: 0 to 1.00%,
Ti: 0 to 0.50%,
Ta: 0 to 0.50%,
Hf: 0 to 0.10%,
Zr: 0 to 0.10%,
Ca: 0 to 0.0200%,
Mg: 0 to 0.0200%, and
rare earth metal: 0 to 0.100%,
with the balance being Fe and impurities,
and that satisfies Formula (1):

$$Nbs \times 0.8 > Nbb \quad (1)$$

where, in Formula (1), an average Nb concentration in percent by mass in an outer layer from a surface of the austenitic stainless steel material to a depth of 10 μm is substituted for Nbs, and an average Nb concentration in percent by mass in a region excluding the outer layer of the austenitic stainless steel material is substituted for Nbb.

[2]

The austenitic stainless steel material according to [1], containing one or more elements selected from a group consisting of, in mass %, sol. Al: 0.001 to 0.100%,
Co: 0.01 to 1.00%,
W: 0.01 to 5.00%,
V: 0.01 to 1.00%,
Ti: 0.01 to 0.50%,
Ta: 0.01 to 0.50%,
Hf: 0.01 to 0.10%,
Zr: 0.01 to 0.10%,
Ca: 0.0001 to 0.0200%,
Mg: 0.0001 to 0.0200%, and
rare earth metal (REM): 0.001 to 0.100%.

[3]

The austenitic stainless steel material according to [1] or [2], in which: a ratio of residual oxide scale on the surface of the austenitic stainless steel material is 5% or less, and a two-dimensional arithmetic average roughness Ra of the surface of the austenitic stainless steel material is 10 μm or less.

Hereunder, the austenitic stainless steel material according to the present embodiment is described in detail. The symbol "%" in relation to elements means "mass percent" unless otherwise stated.

[Features of Austenitic Stainless Steel Material of Present Embodiment]

The austenitic stainless steel material of the present embodiment has the following features.

(Feature 1) The content of each element in the chemical composition is within the range of the present embodiment (that is, within a range indicated hereunder).

(Feature 2) An average Nb concentration Nbs in an outer layer from a surface of the austenitic stainless steel material to a depth of 10 μm, and an average Nb concentration Nbb in a region excluding the outer layer of the austenitic stainless steel material satisfy Formula (1).

$$Nbs \times 0.8 > Nbb \quad (1)$$

[Optional Feature of Austenitic Stainless Steel Material of Present Embodiment]

The austenitic stainless steel material of the present embodiment optionally has the following feature. The austenitic stainless steel material of the present embodiment may have the optional feature, or need not have the optional feature.

(Optional Feature 1) A ratio of residual oxide scale on the surface of the austenitic stainless steel material is 5% or less, and a two-dimensional arithmetic average roughness Ra of the surface of the austenitic stainless steel material is 10 μm or less.

Hereunder, Features 1 to 2 and Optional Feature 1 are described.

[(Feature 1) Regarding Chemical Composition]

The chemical composition of the austenitic stainless steel material of the present embodiment contains the following elements.

C: 0.030% or less

Carbon (C) is unavoidably contained. In other words, the content of C is more than 0%. C forms $M_{23}C_6$-type Cr carbides at grain boundaries. If the content of C is more than 0.030%, Cr carbides will excessively form even if the contents of other elements are within the range of the present embodiment. If Cr carbides excessively form, the concentration of Cr in the vicinity of grain boundaries will decrease. In such case, the amount of Cr supplied to the surface of the austenitic stainless steel material through the grain boundaries will decrease. As a result, uniform formation of a coating film containing $Cr_2O_3$ will be inhibited. In other words, if the content of C is more than 0.030%, Cr carbides will excessively form and the carburization resistance of the austenitic stainless steel material will decrease even if the contents of other elements are within the range of the present embodiment. Therefore, the content of C is to be 0.030% or less. A preferable upper limit of the content of C is 0.026%, more preferably is 0.024%, further preferably is 0.022%, further preferably is 0.020%, and further preferably is 0.018%. The content of C is preferably as low as possible. However, excessively reducing the content of C will increase the production cost. Therefore, for industrial production, a preferable lower limit of the content of C is 0.001%, and more preferably is 0.002%.

Si: 0.01 to 1.00%

Silicon (Si) deoxidizes the austenitic stainless steel material in the production process. If the content of Si is less than 0.01%, the aforementioned advantageous effect will not be sufficiently obtained even if the contents of other elements are within the range of the present embodiment. Furthermore, if the content of Si is less than 0.01%, the production cost will increase. On the other hand, if the content of Si is more than 1.00%, the hot workability of the steel material will decrease even if the contents of other elements are within the range of the present embodiment. Therefore, the content of Si is to be 0.01 to 1.00%. A preferable lower limit of the content of Si is 0.02%, more preferably is 0.03%, further preferably is 0.10%, further preferably is 0.15%, and further preferably is 0.20%. A preferable upper limit of the content of Si is 0.90%, more preferably is 0.85%, further preferably is 0.80%, and further preferably is 0.75%.

Mn: 0.01 to 2.00%

Manganese (Mn) deoxidizes the austenitic stainless steel material in the production process, similarly to Si. In addition, Mn combines with S to form MnS, thereby increasing the hot workability of the austenitic stainless steel material. If the content of Mn is less than 0.01%, the aforementioned advantageous effects will not be sufficiently obtained even if the contents of other elements are within the range of the present embodiment. On the other hand, if the content of Mn is more than 2.00%, in a high temperature environment of 650° C. or more, spinel-type oxides (Cr—Mn spinel-type oxides) containing Cr and Mn will be formed on the surface of the austenitic stainless steel material. The Cr—Mn spinel-type oxides will hinder the formation of a coating film containing $Cr_2O_3$ on the surface of the austenitic stainless steel material in a high temperature environment of 650° C. or more. As a result, the carburization resistance of the austenitic stainless steel material will be lowered. In other words, if the content of Mn is more than 2.00%, the carburization resistance of the austenitic stainless steel material will decrease even if the contents of other elements are within the range of the present embodiment. Therefore, the content of Mn is to be 0.01 to 2.00%. A preferable lower limit of the content of Mn is 0.02%, more preferably is 0.03%, further preferably is 0.05%, further preferably is 0.10%, further preferably is 0.30%, further preferably is 0.40%, and further preferably is 0.50%. A preferable upper limit of the content of Mn is 1.90%, more preferably is 1.80%, further preferably is 1.70%, further preferably is 1.60%, and further preferably is 1.50%.

P: 0.040% or less

Phosphorus (P) is an impurity that is unavoidably contained. In other words, the content of P is more than 0%. If the content of P is more than 0.040%, the weldability and hot workability of the austenitic stainless steel material will decrease even if the contents of other elements are within the range of the present embodiment. Therefore, the content of P is to be 0.040% or less. A preferable upper limit of the content of P is 0.035%, and more preferably is 0.030%. The content of P is preferably as low as possible. However, excessively reducing the content of P will raise the production cost. Therefore, when taking normal industrial production into consideration, a preferable lower limit of the content of P is 0.001%, and more preferably is 0.003%.

S: 0.0100% or less

Sulfur(S) is an impurity that is unavoidably contained. In other words, the content of S is more than 0%. If the content of S is more than 0.0100%, the weldability and hot workability of the austenitic stainless steel material will decrease even if the contents of other elements are within the range of the present embodiment. Therefore, the content of S is to be 0.0100% or less. A preferable upper limit of the content of S is 0.0090%, and more preferably is 0.0080%. The content of S is preferably as low as possible. However, excessively reducing the content of S will raise the production cost. Therefore, when taking normal industrial production into consideration, a preferable lower limit of the content of S is 0.0010%, and more preferably is 0.0020%.

Ni: 8.00 to 18.00%

Nickel (Ni) stabilizes the austenite. In addition, Ni increases the carburization resistance of the austenitic stainless steel material in a high temperature environment of 650° C. or more. If the content of Ni is less than 8.00%, the aforementioned advantageous effects will not be sufficiently obtained even if the contents of other elements are within the range of the present embodiment. On the other hand, if the content of Ni is more than 18.00%, even if the contents of other elements are within the range of the present embodiment, the hot workability of the austenitic stainless steel material will decrease and the raw material cost will increase. Therefore, the content of Ni is to be 8.00 to 18.00%. A preferable lower limit of the content of Ni is 8.50%, more preferably is 9.00%, further preferably is 9.50%, and further preferably is 10.00%. A preferable upper limit of the content of Ni is 17.00%, more preferably is 16.00%, further preferably is 15.00%, and further preferably is 14.00%.

Cr: 15.00 to 25.00%

Chromium (Cr) increases the carburization resistance of the austenitic stainless steel material in a high temperature environment of 650° C. or more. Specifically, in a high temperature environment of 650° C. or more, Cr forms $Cr_2O_3$ on the surface of the austenitic stainless steel material. If $Cr_2O_3$ is uniformly formed on the surface of the austenitic stainless steel material, the carburization resistance of the austenitic stainless steel material will increase. If the content of Cr is less than 15.00%, the aforementioned advantageous effect will not be sufficiently obtained even if the contents of other elements are within the range of the present embodiment. On the other hand, if the content of Cr is more than 25.00%, the stability of austenite will decrease even if the contents of other elements are within the range of the present embodiment. In such case, in a high temperature environment of 650° C. or more, the creep strength of the austenitic stainless steel material will decrease. Therefore, the content of Cr is to be 15.00 to 25.00%. A preferable lower limit of the content of Cr is 15.50%, more preferably is 16.00%, and further preferably is 16.50%. A preferable upper limit of the content of Cr is 23.00%, more preferably is 21.00%, and further preferably is 19.00%.

Mo: 0.10 to 5.00%

Molybdenum (Mo) dissolves in austenite that is the parent phase, and increases the creep strength of the austenitic stainless steel material in a high temperature environment of 650° C. or more by solid-solution strengthening. In addition, Mo forms fine intermetallic compounds in a high temperature environment of 650° C. or more. The fine intermetallic compounds increase the creep strength of the austenitic stainless steel material in a high temperature environment of 650° C. or more by precipitation strengthening. If the content of Mo is less than 0.10%, the aforementioned advantageous effects will not be sufficiently obtained even if the contents of other elements are within the range of the present embodiment. On the other hand, if the content of Mo is more than 5.00%, even if the contents of other elements are within the range of the present embodiment, diffusion of Cr in a high temperature environment of 650° C. or more will be suppressed. As a result, formation of $Cr_2O_3$ on the surface of the austenitic stainless steel material will be suppressed, and the carburization resistance of the austenitic stainless steel material will decrease. Therefore, the content of Mo is to be 0.10 to 5.00%. A preferable lower limit of the content of Mo is 0.20%, more preferably is 0.30%, and further preferably is 0.40%. A preferable upper limit of the content of Mo is 4.00%, more preferably is 3.00%, further preferably is 2.00%, and further preferably is 1.00%.

Nb: 0.20 to 1.00%

Niobium (Nb) forms Nb carbo-nitrides within austenite grains together with N. The amount of dissolved C can be reduced by the formation of Nb carbo-nitrides. If the amount of dissolved C can be reduced, formation of $M_{23}C_6$-type carbides at grain boundaries in a high temperature environment of 650° C. or more will be suppressed. As a result, a decrease in the Cr concentration in the vicinity of the grain boundaries will be suppressed, and the carburization resistance of the austenitic stainless steel material will increase. If the content of Nb is less than 0.20%, the aforementioned advantageous effect will not be obtained even if the contents of other elements are within the range of the present embodiment. On the other hand, if the content of Nb is more than 1.00%, even if the contents of other elements are within the range of the present embodiment, an excessively large amount of Nb carbo-nitrides and Nb carbides will form in the grains. In such case, the strength within the grains will become excessively high, and the strength difference between the inside of the grains and the grain boundaries will be large. Consequently, stress concentration will occur at grain boundary interfaces, and the high temperature strength of the austenitic stainless steel material will decrease. Therefore, the content of Nb is to be 0.20 to 1.00%. A preferable lower limit of the content of Nb is 0.30%, and more preferably is 0.40%. A preferable upper limit of the content of Nb is 0.90%, more preferably is 0.80%, and further preferably is 0.70%.

N: 0.060 to 0.250%

Nitrogen (N) dissolves in the parent phase and stabilizes the austenite. In addition, N forms Nb carbo-nitrides in the austenitic stainless steel material. When Nb carbo-nitrides are formed, the amount of dissolved C in the austenitic stainless steel material decreases. Consequently, formation of Cr carbides can be suppressed in a high temperature environment of 650° C. or more. As a result, the carburization resistance of the austenitic stainless steel material improves. The Nb carbo-nitrides also increase the creep strength of the austenitic stainless steel material in a high temperature environment of 650° C. or more by precipitation strengthening. If the content of N is less than 0.060%, the aforementioned advantageous effects will not be sufficiently obtained even if the contents of other elements are within the range of the present embodiment. On the other hand, if the content of N is more than 0.250%, Cr nitrides ($Cr_2N$) will form at grain boundaries. In such case, because the Cr concentration in the vicinity of the grain boundaries will decrease, diffusion of Cr at the grain boundaries will be suppressed. As a result, even if the contents of other elements are within the range of the present embodiment, the carburization resistance of the austenitic stainless steel material in a high temperature environment of 650° C. or more will decrease. Therefore, the content of N is to be 0.060 to 0.250%. A preferable lower limit of the content of N is 0.070%, and more preferably is 0.080%. A preferable upper limit of the content of N is 0.200%, more preferably is 0.160%, and further preferably is 0.140%.

Cu: more than 2.00 to 4.00%

Copper (Cu) precipitates as a Cu phase in the austenitic stainless steel material in a high temperature environment of 650° C. or more. The Cu phase increases the creep strength of the austenitic stainless steel material in a high temperature environment of 650° C. or more. If the content of Cu is 2.00% or less, the aforementioned advantageous effect will not be sufficiently obtained even if the contents of other elements are within the range of the present embodiment. On the other hand, if the content of Cu is more than 4.00%, even if the contents of other elements are within the range of the present embodiment, a Cu phase will excessively precipitate, and the creep ductility of the austenitic stainless steel material in a high temperature environment of 650° C. or more will decrease, and in addition, the raw material cost will increase. Therefore, the content of Cu is to be within a range of more than 2.00 to 4.00%. A preferable lower limit of the content of Cu is 2.20%, more preferably is 2.40%, and further preferably is 2.60%. A preferable upper limit of the content of Cu is 3.80%, more preferably is 3.60%, and further preferably is 3.40%.

B: 0.0010 to 0.0100%

Boron (B) segregates to grain boundaries in a high temperature environment of 650° C. or more, and thereby increases the grain boundary strength. If the content of B is less than 0.0010%, the aforementioned advantageous effect will not be sufficiently obtained even if the contents of other elements are within the range of the present embodiment. On the other hand, if the content of B is more than 0.0100%, even if the contents of other elements are within the range of the present embodiment, formation of Cr carbides at grain boundaries of the austenitic stainless steel material will be promoted in a high temperature environment of 650° C. or more. Therefore, the content of B is to be 0.0010 to 0.0100%. A preferable lower limit of the content of B is 0.0012%, more preferably is 0.0015%, and further preferably is 0.0020%. A preferable upper limit of the content of B is 0.0090%, more preferably is 0.0080%, further preferably is 0.0070%, further preferably is 0.0060%, further preferably is 0.0050%, and further preferably is 0.0040%.

The balance of the chemical composition of the austenitic stainless steel material of the present embodiment is Fe and impurities. Here, the term "impurities" in the chemical composition means substances which are mixed in from ore and scrap as the raw material or from the production environment or the like when industrially producing the austenitic stainless steel material, and which are permitted within a range that does not adversely affect the austenitic stainless steel material of the present embodiment.

[Optional Elements]

The chemical composition of the austenitic stainless steel material in the present embodiment may further contain, in lieu of a part of Fe, one or more elements selected from a group consisting of:

sol. Al: 0 to 0.100%,
Co: 0 to 1.00%,
W: 0 to 5.00%,
V: 0 to 1.00%,
Ti: 0 to 0.50%,
Ta: 0 to 0.50%,
Hf: 0 to 0.10%,
Zr: 0 to 0.10%
Ca: 0 to 0.0200%,
Mg: 0 to 0.0200%, and
rare earth metal: 0 to 0.100%.

These optional elements are described hereunder.

[First Group: Al]

The chemical composition of the austenitic stainless steel material of the present embodiment may further contain Al in lieu of a part of Fe.

Sol. Al: 0 to 0.100%

Aluminum (Al) is an optional element, and does not have to be contained. That is, the content of Al may be 0%. When Al is contained, that is, when the content of Al is more than 0%, Al deoxidizes the austenitic stainless steel material in the production process. If even a small amount of Al is contained, the aforementioned advantageous effect will be obtained to a certain extent. On the other hand, if the content of Al is more than 0.100%, even if the contents of other elements are within the range of the present embodiment, the hot workability of the austenitic stainless steel material and the creep ductility in a high temperature environment of 650° C. or more will decrease. Therefore, the content of Al is to be 0 to 0.100%. A preferable lower limit of the content of Al is 0.001%, more preferably is 0.005%, and further preferably is 0.010%. A preferable upper limit of the content of Al is 0.080%, more preferably is 0.060%, and further preferably is 0.040%. Here, the term "content of Al" means the content of acid-soluble Al (sol. Al).

[Second Group: Co and W]

The chemical composition of the austenitic stainless steel material of the present embodiment may further contain one or more elements selected from the group consisting of Co and W in lieu of a part of Fe. Each of these elements is an optional element, and does not have to be contained. When contained, each of these elements increases the creep strength of the austenitic stainless steel material.

Co: 0 to 1.00%

Cobalt (Co) is an optional element, and does not have to be contained. That is, the content of Co may be 0%. When Co is contained, that is, when the content of Co is more than 0%, Co stabilizes the structure of the steel material, and thereby increases the creep strength of the austenitic stainless steel material in a high temperature environment of 650° C. or more. If even a small amount of Co is contained, the aforementioned advantageous effect will be obtained to a certain extent. On the other hand, if the content of Co is more than 1.00%, even if the contents of other elements are within the range of the present embodiment, the raw material cost will increase. Therefore, the content of Co is to be 0 to 1.00%. A preferable lower limit of the content of Co is 0.01%, more preferably is 0.05%, further preferably is 0.10%, and further preferably is 0.20%. A preferable upper limit of the content of Co is 0.90%, more preferably is 0.80%, and further preferably is 0.70%.

W: 0 to 5.00%

Tungsten (W) increases the creep strength of the austenitic stainless steel material by solid-solution strengthening in a high temperature environment of 650° C. or more. If even a small amount of W is contained, the aforementioned advantageous effect will be obtained. On the other hand, if the content of W is more than 5.00%, even if the contents of other elements are within the range of the present embodiment, the stability of austenite will decrease and the toughness of the austenitic stainless steel material will decrease. Therefore, the content of W is to be 0 to 5.00%. A preferable lower limit of the content of W is 0.01%, more preferably is 0.05%, further preferably is 0.10%, further preferably is 0.20%, and further preferably is 0.30%. A preferable upper limit of the content of W is 4.00%, more preferably is 3.00%, and further preferably is 2.00%.

[Third Group: V, Ti, Ta, Hf and Zr]

The chemical composition of the austenitic stainless steel material of the present embodiment may further contain one or more elements selected from the group consisting of V, Ti, Ta, Hf and Zr in lieu of a part of Fe. Each of these elements is an optional element, and does not have to be contained. When contained, each of these elements further improves the carburization resistance of the austenitic stainless steel material.

V: 0 to 1.00%

Vanadium (V) is an optional element, and does not have to be contained. That is, the content of V may be 0%. When V is contained, that is, when the content of V is more than 0%, in a high temperature environment of 650° C. or more, V combines with C of the austenitic stainless steel material to form V carbides. The V carbides suppress the formation of Cr carbides in a high temperature environment of 650° C. or more. By this means, uniform formation of a coating film containing $Cr_2O_3$ is further promoted, and the carburization resistance of the austenitic stainless steel material further improves. If even a small amount of V is contained, the aforementioned advantageous effect will be obtained to a certain extent. On the other hand, if the content of V is more than 1.00%, even if the contents of other elements are within the range of the present embodiment, the V carbides will coarsen in a high temperature environment of 650° C. or more. In such case, the creep ductility of the austenitic stainless steel material will decrease. Therefore, the content of V is to be 0 to 1.00%. A preferable lower limit of the content of V is 0.01%, more preferably is 0.02%, and further preferably is 0.03%. A preferable upper limit of the content of V is 0.80%, more preferably is 0.60%, and further preferably is 0.40%.

Ti: 0 to 0.50%

Titanium (Ti) is an optional element, and does not have to be contained. That is, the content of Ti may be 0%. When Ti is contained, that is, when the content of Ti is more than 0%, in a high temperature environment of 650° C. or more, Ti combines with C of the austenitic stainless steel material to form Ti carbides. The Ti carbides suppress the formation of Cr carbides in a high temperature environment of 650° C. or more. By this means, uniform formation of a coating film containing $Cr_2O_3$ is further promoted, and the carburization resistance of the austenitic stainless steel material further improves. If even a small amount of Ti is contained, the aforementioned advantageous effect will be obtained to a certain extent. On the other hand, if the content of Ti is more than 0.50%, even if the contents of other elements are within the range of the present embodiment, the Ti carbides will coarsen, and in a high temperature environment of 650° C. or more the creep ductility of the austenitic stainless steel material will decrease. Therefore, the content of Ti is to be 0 to 0.50%. A preferable lower limit of the content of Ti is 0.01%, more preferably is 0.02%, and further preferably is 0.03%. A preferable upper limit of the content of Ti is 0.45%, more preferably is 0.40%, further preferably is 0.35%, and further preferably is 0.30%.

Ta: 0 to 0.50%

Tantalum (Ta) is an optional element, and does not have to be contained. That is, the content of Ta may be 0%. When Ta is contained, that is, when the content of Ta is more than 0%, Ta combines with C to form Ta carbides. The Ta carbides suppress the formation of Cr carbides in a high temperature environment of 650° C. or more. By this means, uniform formation of a coating film containing $Cr_2O_3$ is further promoted, and the carburization resistance of the austenitic stainless steel material further improves. If even a small amount of Ta is contained, the aforementioned advantageous effect will be obtained to a certain extent. On the other hand, if the content of Ta is more than 0.50%, even if the contents of other elements are within the range of the present embodiment, precipitates will excessively form and the toughness of the austenitic stainless steel material will decrease. Therefore, the content of Ta is to be 0 to 0.50%. A preferable lower limit of the content of Ta is 0.01%, more preferably is 0.02%, and further preferably is 0.03%. A preferable upper limit of the content of Ta is 0.45%, more preferably is 0.40%, and further preferably is 0.35%.

Hf: 0 to 0.10%

Hafnium (Hf) is an optional element, and does not have to be contained. That is, the content of Hf may be 0%. When Hf is contained, that is, when the content of Hf is more than 0%, Hf combines with C to form Hf carbides. The Hf carbides suppress the formation of Cr carbides in a high temperature environment of 650° C. or more. By this means, uniform formation of a coating film containing $Cr_2O_3$ is further promoted, and the carburization resistance of the austenitic stainless steel material further improves. If even a small amount of Hf is contained, the aforementioned advantageous effect will be obtained to a certain extent. On the other hand, if the content of Hf is more than 0.10%, even if the contents of other elements are within the range of the present embodiment, precipitates will excessively form and the toughness of the austenitic stainless steel material will decrease. Therefore, the content of Hf is to be 0 to 0.10%. A preferable lower limit of the content of Hf is 0.01%, more preferably is 0.02%, and further preferably is 0.03%. A preferable upper limit of the content of Hf is 0.08%, and more preferably is 0.06%.

Zr: 0 to 0.10%

Zirconium (Zr) is an optional element, and does not have to be contained. That is, the content of Zr may be 0%. When Zr is contained, that is, when the content of Zr is more than 0%, Zr combines with C to form Zr carbides. The Zr carbides suppress the formation of Cr carbides in a high temperature environment of 650° C. or more. By this means, uniform formation of a coating film containing $Cr_2O_3$ is further promoted, and the carburization resistance of the austenitic stainless steel material further improves. If even a small amount of Zr is contained, the aforementioned advantageous effect will be obtained to a certain extent. On the other hand, if the content of Zr is more than 0.10%, even if the contents of other elements are within the range of the present embodiment, precipitates will excessively form and the toughness of the austenitic stainless steel material will decrease. Therefore, the content of Zr is to be 0 to 0.10%. A preferable lower limit of the content of Zr is 0.01%, more preferably is 0.02%, and further preferably is 0.03%. A preferable upper limit of the content of Zr is 0.08%, and more preferably is 0.06%.

[Fourth Group: Ca, Mg and REM]

The chemical composition of the austenitic stainless steel material of the present embodiment may further contain one or more elements selected from the group consisting of Ca, Mg and REM in lieu of a part of Fe. Each of these elements is an optional element, and does not have to be contained. When contained, each of these elements increases the hot workability of the austenitic stainless steel material.

Ca: 0 to 0.0200%

Calcium (Ca) is an optional element, and does not have to be contained. That is, the content of Ca may be 0%. When Ca is contained, that is, when the content of Ca is more than 0%, Ca fixes S as a sulfide, and thereby increases the hot workability of the austenitic stainless steel material. In addition, Ca deoxidizes the austenitic stainless steel material. If even a small amount of Ca is contained, the aforementioned advantageous effects will be obtained to a certain extent. On the other hand, if the content of Ca is more than 0.0200%, the toughness and hot workability of the austenitic stainless steel material will decrease even if the contents of other elements are within the range of the present embodiment. Therefore, the content of Ca is to be 0 to 0.0200%. A preferable lower limit of the content of Ca is 0.0001%, more preferably is 0.0005%, further preferably is 0.0010%, further preferably is 0.0020%, and further preferably is 0.0050%. A preferable upper limit of the content of Ca is 0.0100%.

Mg: 0 to 0.0200%

Magnesium (Mg) is an optional element, and does not have to be contained. That is, the content of Mg may be 0%. When Mg is contained, that is, when the content of Mg is more than 0%, Mg fixes S as a sulfide, and thereby increases the hot workability of the austenitic stainless steel material. In addition, Mg deoxidizes the austenitic stainless steel material. If even a small amount of Mg is contained, the aforementioned advantageous effects will be obtained to a certain extent. On the other hand, if the content of Mg is more than 0.0200%, the toughness and hot workability of the austenitic stainless steel material will decrease even if the contents of other elements are within the range of the present embodiment. Therefore, the content of Mg is to be 0 to 0.0200%. A preferable lower limit of the content of Mg is 0.0001%, more preferably is 0.0005%, further preferably is 0.0010%, further preferably is 0.0020%, and further preferably is 0.0050%. A preferable upper limit of the content of Mg is 0.0100%.

Rare Earth Metal (REM): 0 to 0.100%

Rare earth metal (REM) is an optional element, and does not have to be contained. That is, the content of REM may be 0%. When REM is contained, that is, when the content of REM is more than 0%, REM fixes S as a sulfide, and thereby increases the hot workability of the austenitic stainless steel material. If even a small amount of REM is contained, the aforementioned advantageous effects will be obtained to a certain extent. On the other hand, if the content of REM is more than 0.100%, even if the contents of other elements are within the range of the present embodiment, an excessively large amount of inclusions such as oxides will form, and the weldability of the austenitic stainless steel material will decrease. Therefore, the content of REM is to be 0 to 0.100%. A preferable lower limit of the content of REM is 0.001%, and more preferably is 0.002%. A preferable upper limit of the content of REM is 0.090%, more preferably is 0.080%, further preferably is 0.070%, and further preferably is 0.060%. In the present disclosure, rare earth metal (REM) is a generic term for a total of 17 elements which are, namely, the 15 elements from lanthanum with atomic number 57 through to lutetium with atomic number 71, scandium with atomic number 21, and yttrium with atomic number 39. The term "content of rare earth metal (REM)" means the total value of the contents of these elements.

[(Feature 2) Regarding Formula (1)]

The austenitic stainless steel material of the present embodiment satisfies Formula (1):

$$Nbs \times 0.8 > Nbb \quad (1)$$

where, in Formula (1), an average Nb concentration in percent by mass in an outer layer from the surface of the austenitic stainless steel material to a depth of 10 μm is substituted for Nbs, and an average Nb concentration in percent by mass in a region excluding the outer layer of the austenitic stainless steel material is substituted for Nbb.

In the present description, the region from the surface of the austenitic stainless steel material to a depth of 10 μm is also referred to simply as "outer layer of the austenitic stainless steel material". In the present description, the region excluding the outer layer of the austenitic stainless steel material is also referred to simply as "interior of the austenitic stainless steel material".

When Formula (1) is transformed, it gives Nbs>1.25× Nbb. That is, the average Nb concentration Nbs in the outer layer of the austenitic stainless steel material is more than 1.25 times the average Nb concentration Nbb in the interior of the austenitic stainless steel material. The reason why the carburization resistance of the austenitic stainless steel material improves if Nb concentrates in the outer layer of the austenitic stainless steel material is considered to be as follows. If Nb concentrates in the outer layer of the austenitic stainless steel material, in a high temperature environment of 650° C. or more, Nb carbo-nitrides will form in the vicinity of the surface of the austenitic stainless steel material. As a result, dissolved C in the vicinity of the surface of the austenitic stainless steel material will be consumed, and the formation of Cr carbides will be suppressed. If the formation of Cr carbides is suppressed, a decrease in the Cr concentration in the vicinity of the grain boundaries will be suppressed. As a result, it will be easy for Cr in the outer layer of the austenitic stainless steel material to diffuse through the grain boundaries to the surface of the austenitic stainless steel material, and thus uniform formation of a coating film containing $Cr_2O_3$ will be promoted.

[Regarding Method for Measuring Nb Concentration]

The average Nb concentration in an outer layer from the surface of the austenitic stainless steel material to a depth of 10 μm is referred to herein as "average Nb concentration Nbs". The average Nb concentration Nbs is determined by the following method. The austenitic stainless steel material is cut perpendicularly to the surface thereof. In the case of the austenitic stainless steel material being a steel pipe, the austenitic stainless steel material is cut perpendicularly to the axial direction of the steel pipe. An arbitrary visual field is selected on the cut surface that includes the surface of the austenitic stainless steel material. Within the selected visual field, a region from the surface of the austenitic stainless steel material to a depth of 10 μm is subjected to line analysis of the concentrations of elements using an electron probe microanalyzer (EPMA). The number of measurement points for the line analysis is set to 100 points. The size of the beam diameter used for the analysis by line analysis is set to 0.1 μm. The direction of the line analysis is set to the direction perpendicular to the surface of the austenitic stainless steel material. The 100-point analysis is performed at a pitch of 0.1 μm from the surface of the austenitic stainless steel material to a depth of 10 μm. The arithmetic average value of the Nb concentrations (mass %) at all the measurement points is defined as the average Nb concentration Nbs.

The average Nb concentration in a region excluding the outer layer of the austenitic stainless steel material is referred to herein as "average Nb concentration Nbb". The average Nb concentration Nbb is determined by the following method. The austenitic stainless steel material is cut perpendicularly to the surface thereof. In the case of the austenitic stainless steel material being a steel pipe, the austenitic stainless steel material is cut perpendicularly to the axial direction of the steel pipe. A machined chip sample is collected from a position located at half the thickness of the austenitic stainless steel material from the surface of the austenitic stainless steel material, in other words, a ½ thickness position. A solution is obtained by dissolving the collected sample using a mixed solution of hydrochloric acid and nitric acid and a mixed solution of sulfuric acid and phosphoric acid prepared based on JIS G1258-2 (2014). The solution is analyzed by high-frequency inductively coupled plasma (ICP) analysis to measure the Nb concentration. Machined chip samples are collected in this manner from an arbitrary three locations on the cut surface of the austenitic stainless steel material. The arithmetic average value of the Nb concentrations (mass %) at the three locations from which the machined chip samples are collected is defined as the average Nb concentration Nbb.

Advantageous Effect of Austenitic Stainless Steel Material of Present Embodiment The austenitic stainless steel material of the present embodiment has the following features.

(Feature 1) The content of each element in the chemical composition is within the range of the present embodiment.

(Feature 2) An average Nb concentration Nbs in an outer layer from the surface of the austenitic stainless steel material to a depth of 10 μm, and an average Nb concentration Nbb in a region excluding the outer layer of the austenitic stainless steel material satisfy Formula (1).

$$Nbs \times 0.8 > Nbb \quad (1)$$

The austenitic stainless steel material of the present embodiment which has Feature 1 and Feature 2 has excellent carburization resistance even in a high temperature environment of 650° C. or more.

[(Optional Feature 1) Regarding Ratio of Residual Oxide Scale and Surface Roughness Ra]

In a case where the austenitic stainless steel material of the present embodiment also has Optional Feature 1 in addition to Feature 1 and Feature 2, the carburization resistance of the austenitic stainless steel material in a high temperature environment of 650° C. or more is further improved.

[Regarding Ratio of Residual Oxide Scale]

In the present description, the ratio of residual oxide scale on the surface of the austenitic stainless steel material of the present embodiment is also referred to simply as "ratio of residual oxide scale". The ratio of residual oxide scale on the surface of the austenitic stainless steel material of the present embodiment is not particularly limited. However, oxide scale inhibits the formation of a coating containing $Cr_2O_3$ in a high temperature environment of 650° C. or more. If the ratio of residual oxide scale is low, the coverage of a coating containing $Cr_2O_3$ on the surface of the austenitic stainless steel material will increase. As a result, in a high temperature environment of 650° C. or more, the carburization resistance of the austenitic stainless steel material will be further improved. Specifically, if the ratio of residual oxide scale is 5% or less, in a high temperature environment of 650° C. or more, the carburization resistance of the austenitic stainless steel material will be further improved. The ratio of residual oxide scale is more preferably 4% or less, further preferably is 3% or less, further preferably is 2% or less, and further preferably is 1% or less. The ratio of residual oxide scale is preferably as low as possible. The ratio of residual oxide scale may be 0%.

[Method for Measuring Ratio of Residual Oxide Scale]

The ratio of residual oxide scale is measured by the following method. A visual field of 30 mm in width and 30 mm in length on the surface of the austenitic stainless steel material is photographed using a digital camera. The photographed image is subjected to black-and-white binarization by image processing, and the area fraction where there is residual oxide scale within the aforementioned visual field is determined. Images are taken at an arbitrary three locations on the surface of the austenitic stainless steel material. The arithmetic average value of the area fractions obtained by photographing the three locations is defined as the ratio of residual oxide scale (%).

[Regarding Two-Dimensional Arithmetic Average Roughness Ra]

In the present description, the two-dimensional arithmetic average roughness Ra of the surface of the austenitic stainless steel material of the present embodiment is also referred to simply as "surface roughness Ra". The surface roughness Ra of the austenitic stainless steel material of the present embodiment is not particularly limited. However, if the surface roughness Ra of the austenitic stainless steel material is low, the area surface of the austenitic stainless steel material will become smaller. As a result, the coverage of the surface of the austenitic stainless steel material by a coating film containing $Cr_2O_3$ will increase. Specifically, if the surface roughness Ra of the austenitic stainless steel material is 10 μm or less, the coverage of the surface of the austenitic stainless steel material by a coating film containing $Cr_2O_3$ will increase. As a result, the carburization resistance of the austenitic stainless steel material in a high temperature environment of 650° C. or more will further improve. The surface roughness Ra of the austenitic stainless steel material is more preferably 8 μm or less, further preferably is 5 μm or less, and further preferably is 2 μm or less. Although not particularly limited, a lower limit of the surface roughness Ra of the austenitic stainless steel material is, for example, 1 μm.

[Method for Measuring Surface Roughness Ra]

The two-dimensional arithmetic average roughness Ra is measured by the following method. Test specimens that each include the surface of the austenitic stainless steel material are taken. Each test specimen includes an area of 10 mm in width and 10 mm in length of the surface of the austenitic stainless steel material. The test specimens are taken from the austenitic stainless steel material at an arbitrary three locations. The two-dimensional arithmetic average roughness Ra (μm) of the surface of the austenitic stainless steel material included in each test specimen is measured using a three-dimensional shape measuring apparatus. Measurements are made in two directions as the measurement directions, namely, the longitudinal direction on the surface of the austenitic stainless steel material, and a direction perpendicular thereto, and the larger of the two measured values is defined as the two-dimensional arithmetic average roughness Ra (μm) of the austenitic stainless steel material. In the case of the austenitic stainless steel material being a steel pipe, measurements are made in the axial direction of the steel pipe and the circumferential direction of the steel pipe as the two directions, and the larger of the two measured values is defined as the two-dimensional arithmetic average roughness Ra (μm) of the austenitic stainless steel material. The sampling length is set to 1000 μm. In a case where some oxide scale remains on the surface of the austenitic stainless steel material, locations where there is no remaining oxide scale are selected to perform the measurement. The arithmetic average of the measurement results obtained at the three locations is defined as the two-dimensional arithmetic average roughness Ra (μm).

[Advantageous Effect of Austenitic Stainless Steel Material of Present Embodiment in Case where Optional Feature 1 is Satisfied]

In a case where the austenitic stainless steel material of the present embodiment has Optional Feature 1 in addition to Feature 1 and Feature 2, the carburization resistance of the austenitic stainless steel material is further improved in a high temperature environment of 650° C. or more.

[Shape of Austenitic Stainless Steel Material]

The shape of the austenitic stainless steel material of the present embodiment is not particularly limited. The austenitic stainless steel material is, for example, a steel pipe or a steel plate. Although not particularly limited, the thickness of the austenitic stainless steel material is, for example, 1 to 100 mm.

[Production Method]

An example of a method for producing the austenitic stainless steel material of the present embodiment will now be described. An austenitic stainless steel material composed as described above may also be produced by a production method other than the production method described hereinafter. However, the production method described hereunder is a preferable example of a method for producing the austenitic stainless steel material of the present embodiment.

The method for producing the austenitic stainless steel material of the present embodiment includes the following processes.

(Process 1) Starting material preparation process (Process 2) Hot working process (Process 3) Solution treatment process (Process 4) Pickling treatment process The method for producing the austenitic stainless steel material of the present embodiment optionally includes the following process.

(Optional Process 1) Cold Working Process

[(Process 1) Starting Material Preparation Process]

In the starting material preparation process, a starting material having the chemical composition described above is prepared. The starting material may be supplied by a third party or may be produced. The starting material may be an ingot, a slab, a bloom, or a billet. In the case of producing the starting material, the starting material is produced by the following method. Molten steel having the chemical composition described above is produced. The produced molten steel is used to produce an ingot by an ingot-making process. The produced molten steel may also be used to produce a slab, a bloom, or a billet (cylindrical starting material) by a continuous casting process. Hot working may be performed on the produced ingot, slab, or bloom to produce a billet. For example, hot forging may be performed on the ingot to produce a cylindrical billet, and the billet may be used as the starting material (cylindrical starting material). In such case, although not particularly limited, the temperature of the starting material immediately before the start of the hot working is, for example, 900 to 1300° C.

[(Process 2) Hot Working Process]

In the hot working process, hot working is performed on the starting material to produce an intermediate steel material having a predetermined shape. The intermediate steel material, for example, may be a steel pipe, may be a steel plate, or may be a steel bar.

If the intermediate steel material is a steel pipe, the following working is performed in the hot working process. A cylindrical starting material is prepared as the starting material. A through-hole is formed in the cylindrical starting material along the central axis thereof by machining. Hot extrusion, which is typified by the Ugine-Sejournet process, is performed on the cylindrical starting material in which the through-hole has been formed, to thereby produce an intermediate steel material (steel pipe). Instead of the hot extrusion, a steel pipe may be produced by performing piercing-rolling according to the Mannesmann process. In such case, the starting material is pierced and rolled using a piercing machine. The starting material subjected to piercing and rolling is further subjected to hot rolling with a mandrel mill, a stretch reducing mill, a sizing mill or the like to obtain an intermediate steel material (steel pipe).

If the intermediate steel material is a steel plate, the following hot rolling is performed in the hot working process. One or a plurality of rolling mills equipped with a pair of work rolls is used. Hot rolling is performed on the starting material using the one or more rolling mills to produce a steel plate.

If the intermediate steel material is a steel bar, the hot working process includes, for example, a rough rolling process and a finish rolling process. In the rough rolling process, hot rolling is performed on the starting material to produce a billet. In the rough rolling process, for example, a blooming mill is used. In a case where a continuous mill is arranged downstream of the blooming mill, the continuous mill may be used to further perform hot rolling on the billet after blooming to thereby produce a billet of an even smaller size. In the continuous mill, for example, horizontal stands having a pair of horizontal rolls, and vertical stands having a pair of vertical rolls are alternately arranged in a row. In the finish rolling process, the billet after the rough rolling process is reheated to a well-known temperature (900 to 1300° C.). In the finish rolling process, after the billet has been heated, the billet is subjected to hot rolling using a continuous mill to produce a steel bar.

Note that, hot forging may be performed as the hot working process to produce an intermediate steel material (steel pipe, steel plate, or steel bar). The hot forging is, for example, extend forging.

[(Process 3) Solution Treatment Process]

In the solution treatment process, the intermediate steel material after the hot working process or after the cold working process is subjected to a solution treatment. Precipitates in the intermediate steel material are dissolved by the solution treatment. In addition, in the solution treatment process, austenite grains in the steel material are adjusted.

The solution treatment is performed by the following method. The intermediate steel material after the cold working process is loaded into a heat treatment furnace. Here, a solution treatment temperature in the heat treatment furnace is denoted by "T", and a time for which the intermediate steel material is held at the solution treatment temperature T in the heat treatment furnace is denoted by "t". The intermediate steel material is held at a temperature T (° C.) for a time t (mins) that satisfy the following conditions.

Solution treatment temperature T: 950° C. or more

Holding time t in solution treatment: 2 minutes or more

In addition, the solution treatment conditions are adjusted to satisfy Formula (2).

$$(T-940)\times\left(\log(t)+10^2\times[Nbb]-10^2\times P_{O2}\right)\geq 12900 \quad (2)$$

T: solution treatment temperature (° C.)

t: holding time in solution treatment (mins)

[Nbb]: average Nb concentration of interior of the austenitic stainless steel material (mass %)

$P_{O2}$: oxygen partial pressure inside heat treatment furnace (atm)

log(t): common logarithm of t, base 10

In a case where the solution treatment temperature T is less than 950° C., the holding time in the solution treatment is less than two minutes, or the solution treatment conditions do not satisfy Formula (2), Cr carbides or CrN will not sufficiently dissolve. In such case, dissolved Cr in the austenitic stainless steel material will be reduced, and the carburization resistance of the austenitic stainless steel material will decrease. In addition, since the formation of oxide scale mainly composed of Fe and Cr will be suppressed, concentration of Nb to the outer layer of the austenitic stainless steel material will be suppressed. As a result, the average Nb concentration Nbs will decrease, and the austenitic stainless steel material will not satisfy Formula (1).

Let F2 be defined as $F2=(T-940)\times(\log(t)+10^2\times[Nbb]-10^2\times P_{O2})$. FIG. 1 is a graph illustrating the relation between the conditions of the solution treatment and the concentration of Nb in the outer layer of the austenitic stainless steel material. FIG. 1 was created by plotting the results of Test Nos. 1 to 21 and 24 in Examples to be described later. The abscissa in FIG. 1 represents F2. The ordinate in FIG. 1 represents numerical values obtained by dividing the average Nb concentration Nbs in the outer layer of the austenitic stainless steel material by the average Nb concentration Nbb in the interior of the austenitic stainless steel material. A larger value on the ordinate in FIG. 1 means a larger concentration of Nb in the outer layer of the austenitic stainless steel material. Referring to FIG. 1, it can be seen that the higher that the value of F2 is, the greater the degree to which Nb tends to concentrate in the outer layer of the austenitic stainless steel material. When F2 is 12900 or more, the average Nb concentration Nbs in the outer layer becomes more than 1.25 times the average Nb concentration Nbb in the interior of the austenitic stainless steel material.

A preferable lower limit of the solution treatment temperature Tis 1000° C., more preferably is 1010° C., and further preferably is 1020° C. Although an upper limit of the solution treatment temperature T is not particularly specified, for example, the upper limit is 1350° C. A preferable upper limit of the solution treatment temperature T is 1290° C., more preferably is 1280° C., further preferably is 1270° C., and further preferably is 1260° C.

A preferable lower limit of the holding time t in the solution treatment is 3 mins, more preferably is 4 mins, and further preferably is 5 mins. Although an upper limit of the holding time t in the solution treatment is not particularly specified, taking economic efficiency into consideration, the upper limit is, for example, 60 mins.

[(Process 4) Pickling Treatment Process]

In the pickling treatment process, the intermediate steel material after the solution treatment is subjected to a pickling treatment. Oxide scale formed on the surface of the intermediate steel material is removed by the pickling treatment. The oxide scale formed on the surface of the intermediate steel material before the pickling treatment process mainly consists of Fe oxides and/or Fe—Cr spinel oxides and/or Cr oxides. The pickling treatment is performed in order to sufficiently remove oxide scale from the surface of the intermediate steel material so as to make the metal surface the outermost surface. By making the metal surface the outermost surface, a coating film containing $Cr_2O_3$ that is excellent in carburization resistance is formed.

The pickling solution may be any solution that can remove oxide scale formed by the solution treatment. For example, the pickling solution is a mixed solution containing nitric acid and/or hydrofluoric acid. The concentration of nitric acid and/or hydrofluoric acid in the mixed solution is not particularly limited. However, if the concentration of nitric acid and/or hydrofluoric acid in the mixed solution is 5.0% or more in total, the oxide scale formed by the solution treatment can be removed more efficiently, and the ratio of residual oxide scale will decrease. On the other hand, if the concentration of nitric acid and/or hydrofluoric acid in the mixed solution is 15.0% or less, acid corrosion along grain boundaries on the metal surface of the austenitic stainless steel material can be suppressed, and an increase in the surface area can thus be suppressed. Therefore, preferably the concentration of nitric acid and/or hydrofluoric acid in the mixed solution is within the range of 5.0% to 15.0%. The lower limit of the concentration of nitric acid and/or hydrofluoric acid in the mixed solution is more preferably 5.5%, and further preferably is 6.0%. The upper limit of the concentration of nitric acid and/or hydrofluoric acid in the mixed solution is more preferably 14.5%, and further preferably is 14.0%.

[(Optional Process 1) Cold Working Process]

A cold working process may be performed or need not be performed. In the case of performing a cold working process, the cold working process is to be performed at a timing that is after the hot working process (Process 2) and is before the solution treatment process (Process 3). In the cold working process, cold working is performed on the intermediate steel material after the intermediate steel material has undergone hot working and has been subjected to the pickling treatment. If the intermediate steel material is a steel pipe or a steel bar, the cold working is, for example, cold drawing. If the intermediate steel material is a steel plate, the cold working is, for example, cold rolling. Although not particularly limited, the reduction of area in the cold working process is, for example, 10 to 90%.

The austenitic stainless steel material of the present embodiment is produced by the above production process.

EXAMPLES

The advantageous effect of the austenitic stainless steel material of the present embodiment is described more specifically hereunder by way of examples. The conditions adopted in the following examples are one example of conditions adopted for confirming the feasibility and advantageous effect of the austenitic stainless steel material of the present embodiment. Accordingly, the austenitic stainless steel material of the present embodiment is not limited to this one example of conditions.

Molten steels having the chemical compositions shown in Table 1 were produced using a vacuum furnace.

TABLE 1

| Test | Chemical Composition (unit is mass %; balance is Fe and impurities) | | | | | | | | | | | |
|---|---|---|---|---|---|---|---|---|---|---|---|---|
| Number | C | Si | Mn | P | S | Ni | Cr | Mo | Nb | N | Cu | B |
| 1 | 0.021 | 0.63 | 0.82 | 0.032 | 0.0062 | 12.41 | 22.08 | 4.54 | 0.76 | 0.168 | 2.65 | 0.0015 |
| 2 | 0.018 | 0.02 | 0.52 | 0.021 | 0.0017 | 13.09 | 17.38 | 1.65 | 0.85 | 0.171 | 3.07 | 0.0048 |
| 3 | 0.023 | 0.72 | 0.31 | 0.023 | 0.0005 | 9.59 | 15.84 | 1.61 | 0.72 | 0.184 | 2.13 | 0.0019 |
| 4 | 0.008 | 0.47 | 0.74 | 0.037 | 0.0023 | 13.94 | 24.81 | 1.82 | 0.75 | 0.067 | 3.30 | 0.0084 |
| 5 | 0.025 | 0.80 | 1.79 | 0.024 | 0.0047 | 14.12 | 16.95 | 2.28 | 0.94 | 0.201 | 3.62 | 0.0088 |
| 6 | 0.021 | 0.19 | 0.96 | 0.013 | 0.0003 | 14.80 | 22.25 | 0.69 | 0.74 | 0.204 | 2.05 | 0.0030 |
| 7 | 0.019 | 0.89 | 1.28 | 0.015 | 0.0090 | 11.30 | 18.06 | 4.25 | 0.75 | 0.217 | 3.11 | 0.0043 |
| 8 | 0.026 | 0.38 | 1.18 | 0.019 | 0.0082 | 15.65 | 17.03 | 3.16 | 0.51 | 0.239 | 3.74 | 0.0018 |
| 9 | 0.013 | 0.71 | 0.24 | 0.035 | 0.0006 | 13.17 | 19.17 | 4.92 | 0.49 | 0.183 | 2.06 | 0.0022 |
| 10 | 0.009 | 0.10 | 1.40 | 0.035 | 0.0088 | 16.51 | 24.47 | 2.02 | 0.62 | 0.186 | 2.49 | 0.0055 |
| 11 | 0.005 | 0.72 | 1.62 | 0.003 | 0.0001 | 14.77 | 24.36 | 2.18 | 0.54 | 0.241 | 2.23 | 0.0042 |
| 12 | 0.008 | 0.94 | 0.30 | 0.010 | 0.0019 | 12.10 | 22.37 | 0.21 | 0.53 | 0.097 | 2.76 | 0.0085 |
| 13 | 0.019 | 0.73 | 0.89 | 0.023 | 0.0071 | 8.31 | 20.46 | 2.71 | 0.87 | 0.183 | 3.40 | 0.0059 |
| 14 | 0.006 | 0.37 | 1.21 | 0.006 | 0.0052 | 9.07 | 20.29 | 0.89 | 0.95 | 0.128 | 2.24 | 0.0045 |
| 15 | 0.013 | 0.63 | 0.97 | 0.009 | 0.0028 | 13.81 | 19.28 | 3.52 | 0.88 | 0.184 | 2.34 | 0.0096 |
| 16 | 0.005 | 0.90 | 1.96 | 0.019 | 0.0025 | 10.00 | 19.35 | 1.95 | 0.85 | 0.105 | 3.64 | 0.0015 |
| 17 | 0.022 | 0.43 | 1.63 | 0.034 | 0.0025 | 16.01 | 16.56 | 1.84 | 0.81 | 0.063 | 3.02 | 0.0098 |
| 18 | 0.028 | 0.87 | 0.45 | 0.007 | 0.0060 | 8.21 | 23.21 | 1.41 | 0.59 | 0.216 | 3.03 | 0.0083 |
| 19 | 0.015 | 0.11 | 0.55 | 0.011 | 0.0025 | 11.44 | 18.42 | 0.39 | 0.71 | 0.203 | 2.38 | 0.0067 |
| 20 | 0.004 | 0.21 | 0.95 | 0.016 | 0.0007 | 11.34 | 23.25 | 1.81 | 0.61 | 0.209 | 3.35 | 0.0062 |
| 21 | 0.010 | 0.55 | 1.32 | 0.023 | 0.0081 | 9.35 | 20.66 | 3.01 | 0.82 | 0.104 | 2.86 | 0.0063 |

TABLE 1-continued

| | | | | | | | | | | | | |
|---|---|---|---|---|---|---|---|---|---|---|---|---|
| 22 | 0.004 | 0.87 | 1.75 | 0.016 | 0.0056 | 16.05 | 22.24 | 1.69 | 0.83 | 0.085 | 2.27 | 0.0034 |
| 23 | 0.009 | 0.79 | 0.26 | 0.007 | 0.0063 | 10.81 | 22.12 | 1.42 | 0.49 | 0.179 | 2.45 | 0.0055 |
| 24 | 0.004 | 0.84 | 1.94 | 0.004 | 0.0043 | 17.44 | 17.39 | 0.32 | 0.28 | 0.220 | 3.95 | 0.0096 |
| 25 | 0.006 | 0.21 | 1.24 | 0.026 | 0.0083 | 10.82 | 19.82 | 3.94 | 0.53 | 0.161 | 2.11 | 0.0044 |
| 26 | 0.079 | 0.40 | 0.59 | 0.015 | 0.0084 | 17.18 | 19.87 | 0.78 | 0.42 | 0.131 | 3.51 | 0.0072 |
| 27 | 0.002 | 0.97 | 1.07 | 0.003 | 0.0020 | 13.82 | 12.94 | 3.23 | 0.40 | 0.140 | 2.80 | 0.0029 |
| 28 | 0.007 | 0.73 | 0.48 | 0.018 | 0.0034 | 6.89 | 18.70 | 2.50 | 0.97 | 0.214 | 3.92 | 0.0077 |
| 29 | 0.019 | 0.74 | 1.79 | 0.008 | 0.0030 | 12.73 | 19.52 | 2.78 | 0.02 | 0.084 | 3.69 | 0.0052 |

| Test | Chemical Composition (unit is mass %; balance is Fe and impurities) | | | | | | | | | | |
|---|---|---|---|---|---|---|---|---|---|---|---|
| Number | Al | Co | W | V | Ti | Ta | Hf | Zr | Ca | Mg | REM |
| 1 | — | — | — | — | — | — | — | — | — | — | — |
| 2 | — | — | — | — | — | — | — | — | — | — | — |
| 3 | 0.048 | — | — | — | — | — | — | — | — | — | — |
| 4 | — | 0.79 | — | — | — | — | — | — | — | — | — |
| 5 | — | — | 4.31 | — | — | — | — | — | — | — | — |
| 6 | — | — | — | 0.91 | — | — | — | — | — | — | — |
| 7 | — | — | — | — | 0.38 | — | — | — | — | — | — |
| 8 | — | — | — | — | — | 0.12 | — | — | — | — | — |
| 9 | — | — | — | — | — | — | 0.05 | — | — | — | — |
| 10 | — | — | — | — | — | — | — | 0.04 | — | — | — |
| 11 | — | — | — | — | — | — | — | — | 0.0157 | — | — |
| 12 | — | — | — | — | — | — | — | — | — | 0.0131 | — |
| 13 | — | — | — | — | — | — | — | — | — | — | 0.006 |
| 14 | 0.016 | 0.58 | 0.03 | 0.77 | 0.25 | 0.09 | 0.01 | 0.04 | 0.0040 | 0.0056 | 0.006 |
| 15 | 0.018 | 0.21 | 1.21 | 0.26 | 0.17 | 0.03 | 0.01 | 0.01 | 0.0006 | 0.0002 | 0.044 |
| 16 | 0.075 | 0.08 | 3.84 | 0.71 | 0.49 | 0.13 | 0.05 | 0.03 | 0.0003 | 0.0039 | 0.067 |
| 17 | 0.003 | 0.89 | 2.19 | 0.77 | 0.23 | 0.08 | 0.03 | 0.01 | 0.0024 | 0.0021 | 0.009 |
| 18 | 0.028 | 0.49 | 4.57 | 0.10 | 0.23 | 0.21 | 0.05 | 0.07 | 0.0056 | 0.0083 | 0.004 |
| 19 | 0.026 | 0.79 | 0.76 | 0.88 | 0.16 | 0.06 | 0.02 | 0.01 | 0.0045 | 0.0056 | 0.048 |
| 20 | 0.027 | 0.82 | 0.41 | 0.30 | 0.37 | 0.27 | 0.02 | 0.07 | 0.0017 | 0.0060 | 0.018 |
| 21 | 0.047 | 0.42 | 1.08 | 0.87 | 0.05 | 0.03 | 0.01 | 0.03 | 0.0048 | 0.0008 | 0.015 |
| 22 | 0.009 | 0.35 | 1.61 | 0.36 | 0.48 | 0.35 | 0.06 | 0.01 | 0.0040 | 0.0008 | 0.060 |
| 23 | 0.049 | 0.33 | 4.89 | 0.82 | 0.12 | 0.05 | 0.04 | 0.02 | 0.0056 | 0.0021 | 0.045 |
| 24 | 0.057 | 0.93 | 0.90 | 0.42 | 0.26 | 0.13 | 0.05 | 0.01 | 0.0001 | 0.0034 | 0.009 |
| 25 | 0.085 | 0.92 | 1.86 | 0.90 | 0.23 | 0.01 | 0.02 | 0.07 | 0.0037 | 0.0009 | 0.016 |
| 26 | 0.017 | 0.42 | 3.80 | 0.32 | 0.32 | 0.33 | 0.07 | 0.03 | 0.0022 | 0.0024 | 0.026 |
| 27 | 0.050 | 0.95 | 0.07 | 0.43 | 0.10 | 0.17 | 0.04 | 0.05 | 0.0009 | 0.0009 | 0.003 |
| 28 | 0.029 | 0.63 | 4.92 | 0.74 | 0.29 | 0.29 | 0.06 | 0.02 | 0.0016 | 0.0077 | 0.028 |
| 29 | 0.009 | 0.48 | 1.96 | 0.26 | 0.04 | 0.06 | 0.01 | 0.07 | 0.0003 | 0.0071 | 0.035 |

In Table 1, the symbol "-" means that the content of the corresponding element was less than the detection limit. Cylindrical ingots were produced using the molten steels of the test numbers shown in Table 1. The ingots were heated for three hours at 1220° C. After being heated, each ingot was subjected to hot forging to produce a cylindrical billet. A through-hole was formed along the central axis of each cylindrical billet by machining. Each of the cylindrical billets in which the through-hole was formed was subjected to hot extrusion to produce an intermediate steel material (steel pipe). The temperature of the billet before performing the hot extrusion was 1200° C. The intermediate steel material after the hot extrusion was subjected to cold drawing to produce an intermediate steel material (steel pipe) having a diameter of 45 mm and a wall thickness of 9.5 mm.

Each obtained intermediate steel material was subjected to a solution treatment in which the solution treatment temperature T, the holding time t, and the oxygen partial pressure (atm) were as shown in Table 2. After undergoing the solution treatment, the steel material was cooled. After the intermediate steel material was cooled, a pickling treatment was performed using a pickling solution to thereby remove oxide scale on the surface of the intermediate steel material. The pickling solution was a mixed solution containing nitric acid and hydrofluoric acid. The total concentration of nitric acid and hydrofluoric acid with respect to the mixed solution is described in the column "Pickling Solution Concentration (vol %)" in Table 2. An austenitic stainless steel material of each test number was produced by the above process.

TABLE 2

| Test Number | Solution Treatment Temperature T (° C.) | Solution Treatment Holding Time t (mins) | Oxygen Partial Pressure (atm) | Formula (2) Left Side | Pickling Solution Concentration (vol %) | Ratio of Residual Oxide Scale | Surface Roughness Ra | Nbs (mass %) | Nbb (mass %) | Formula (1) | Carburization Resistance |
|---|---|---|---|---|---|---|---|---|---|---|---|
| 1 | 1200 | 5 | $2.1 \times 10^{-1}$ | 14482 | 10 | E | E | 1.03 | 0.76 | ○ | E |
| 2 | 1170 | 5 | $2.1 \times 10^{-1}$ | 14881 | 10 | E | E | 1.31 | 0.85 | ○ | E |
| 3 | 1200 | 5 | $2.1 \times 10^{-1}$ | 13442 | 10 | E | E | 0.93 | 0.72 | ○ | E |
| 4 | 1200 | 5 | $2.1 \times 10^{-1}$ | 14222 | 10 | E | E | 0.95 | 0.75 | ○ | E |
| 5 | 1120 | 5 | $2.1 \times 10^{-1}$ | 13266 | 10 | E | E | 1.27 | 0.94 | ○ | E |
| 6 | 1200 | 5 | $2.1 \times 10^{-1}$ | 13962 | 10 | E | E | 0.98 | 0.74 | ○ | E |
| 7 | 1200 | 5 | $2.1 \times 10^{-1}$ | 14222 | 10 | E | E | 1.04 | 0.75 | ○ | E |
| 8 | 1200 | 5 | $1.0 \times 10^{-15}$ | 13442 | 10 | E | E | 0.72 | 0.51 | ○ | E |

TABLE 2-continued

| Test Number | Solution Treatment Temperature T (° C.) | Solution Treatment Holding Time t (mins) | Oxygen Partial Pressure (atm) | Formula (2) Left Side | Pickling Solution Concentration (vol %) | Ratio of Residual Oxide Scale | Surface Roughness Ra | Nbs (mass %) | Nbb (mass %) | Formula (1) | Carburization Resistance |
|---|---|---|---|---|---|---|---|---|---|---|---|
| 9 | 1200 | 5 | $1.0 \times 10^{-15}$ | 12922 | 10 | E | E | 0.66 | 0.49 | ○ | E |
| 10 | 1150 | 5 | $1.0 \times 10^{-15}$ | 13167 | 10 | E | E | 0.92 | 0.62 | ○ | E |
| 11 | 1200 | 5 | $1.0 \times 10^{-15}$ | 14222 | 10 | E | E | 0.77 | 0.54 | ○ | E |
| 12 | 1200 | 5 | $1.0 \times 10^{-15}$ | 13962 | 10 | E | E | 0.73 | 0.53 | ○ | E |
| 13 | 1090 | 5 | $1.0 \times 10^{-15}$ | 13155 | 10 | E | E | 1.11 | 0.87 | ○ | E |
| 14 | 1200 | 5 | $2.1 \times 10^{-1}$ | 19422 | 10 | E | E | 1.35 | 0.95 | ○ | E |
| 15 | 1200 | 5 | $2.1 \times 10^{-1}$ | 17602 | 10 | E | E | 1.11 | 0.88 | ○ | E |
| 16 | 1200 | 5 | $2.1 \times 10^{-1}$ | 16822 | 10 | E | E | 1.19 | 0.85 | ○ | E |
| 17 | 1200 | 5 | $2.1 \times 10^{-1}$ | 15782 | 6 | E | E | 1.02 | 0.81 | ○ | E |
| 18 | 1200 | 5 | $1.0 \times 10^{-15}$ | 15522 | 6 | E | E | 0.87 | 0.59 | ○ | E |
| 19 | 1200 | 5 | $1.0 \times 10^{-15}$ | 18642 | 6 | E | E | 0.94 | 0.71 | ○ | E |
| 20 | 1200 | 5 | $1.0 \times 10^{-15}$ | 16042 | 12 | E | E | 0.83 | 0.61 | ○ | E |
| 21 | 1100 | 5 | $1.0 \times 10^{-15}$ | 13232 | 12 | E | E | 1.08 | 0.82 | ○ | E |
| 22 | 1100 | 5 | $1.0 \times 10^{-15}$ | 13392 | 1 | A | E | 1.36 | 0.83 | ○ | A |
| 23 | 1200 | 5 | $1.0 \times 10^{-15}$ | 12922 | 20 | E | A | 0.76 | 0.49 | ○ | A |
| 24 | 950 | 5 | $1.0 \times 10^{-15}$ | 287 | 10 | E | E | 0.27 | 0.28 | x | NA |
| 25 | 1200 | 1 | $1.0 \times 10^{-15}$ | 13780 | 10 | E | E | 0.61 | 0.53 | x | NA |
| 26 | 1200 | 5 | $2.1 \times 10^{-1}$ | 5642 | 10 | E | E | 0.63 | 0.42 | ○ | NA |
| 27 | 1200 | 5 | $2.1 \times 10^{-1}$ | 5122 | 10 | E | E | 0.67 | 0.40 | ○ | NA |
| 28 | 1200 | 5 | $2.1 \times 10^{-1}$ | 19942 | 10 | E | E | 1.34 | 0.97 | ○ | NA |
| 29 | 1200 | 5 | $1.0 \times 10^{-15}$ | 702 | 10 | E | E | 0.02 | 0.02 | x | NA |

[Evaluation Tests]

The austenitic stainless steel material of each test number was subjected to the following evaluation tests.

[Nb Concentration Measurement]

The average Nb concentration Nbs was determined by the following method. The austenitic stainless steel material (steel pipe) of each test number was cut perpendicularly to the surface thereof. Specifically, the austenitic stainless steel material (steel pipe) was cut perpendicularly to the axial direction. An arbitrary visual field was selected on the cut surface that included the inner surface of the austenitic stainless steel material (steel pipe). Within the selected visual field, a region from the surface of the austenitic stainless steel material to a depth of 10 μm was subjected to line analysis of the concentrations of elements using an EPMA. The number of measurement points for the line analysis was set to 100 points. The size of the beam diameter used for the analysis by line analysis was set to 0.1 μm. The direction of the line analysis was set to the direction perpendicular to the surface of the austenitic stainless steel material. The 100-point analysis was performed at a pitch of 0.1 μm from the surface of the austenitic stainless steel material to a depth of 10 μm. The arithmetic average of the Nb concentrations (mass %) at all the measurement points was defined as the average Nb concentration Nbs. The results are shown in the column "Nbs (mass %)" in Table 2.

The average Nb concentration Nbb was determined by the following method. The austenitic stainless steel material of each test number was cut perpendicularly to the surface thereof. Specifically, the austenitic stainless steel material (steel pipe) was cut perpendicularly to the axial direction. A machined chip sample was collected from a position located at half the thickness of the austenitic stainless steel material from the surface of the austenitic stainless steel material, in other words, a ½ thickness position. A solution was obtained by dissolving the collected sample using a mixed solution of hydrochloric acid and nitric acid and a mixed solution of sulfuric acid and phosphoric acid prepared based on JIS G1258-2 (2014). The solution was analyzed by ICP analysis and the Nb concentration was measured. Machined chip samples were collected in this manner from an arbitrary three locations on the cut surface of the austenitic stainless steel material. The arithmetic average value of the Nb concentrations (mass %) at the three locations from which the machined chip samples were collected was defined as the average Nb concentration Nbb. The results are shown in the column "Nbb (mass %)" in Table 2.

[Measurement of Ratio of Residual Oxide Scale]

The ratio of residual oxide scale was measured by the following method. A visual field of 30 mm in width and 30 mm in length on the inner surface of the austenitic stainless steel material (steel pipe) of each test number was photographed using a digital camera. The photographed image was subjected to black-and-white binarization by image processing, and the area fraction where there was residual oxide scale within the aforementioned visual field was determined. Images were taken at an arbitrary three locations on the inner surface of the austenitic stainless steel material (steel pipe). The arithmetic average of the area fractions obtained by photographing the three locations was defined as the ratio of residual oxide scale (%). The results are shown in the column "Ratio of Residual Oxide Scale" in Table 2. In Table 2, a case where the ratio of residual oxide scale was 5% or less is indicated by "E (Excellent)", and a case where the ratio of residual oxide scale was more than 5% is indicated by "A (Acceptable)". Note that, in Test No. 22 in which the ratio of residual oxide scale was more than 5%, the ratio of residual oxide scale was 13% or less.

[Measurement of Two-Dimensional Arithmetic Average Roughness Ra]

The two-dimensional arithmetic average roughness Ra was measured by the following method. Test specimens including the inner surface of the austenitic stainless steel material were taken from the austenitic stainless steel material of each test number. Each test specimen included an area of 10 mm in width and 10 mm in length of the inner surface of the austenitic stainless steel material. The test specimens were taken from the austenitic stainless steel material at an arbitrary three locations. The two-dimensional arithmetic average roughness Ra (μm) of the inner surface of the austenitic stainless steel material included in each test specimen was measured using a 3D shape measuring apparatus VR-3200 manufactured by KEYENCE Corporation. Measurements were made in two directions as the measurement directions, namely, the axial direction of the austenitic stainless steel material (steel pipe) (pipe longitudinal direction) and a direction perpendicular thereto (pipe circumferential direction), and the larger of the two measured values was defined as the two-dimensional arithmetic average roughness Ra (μm) of the austenitic stainless steel material. The sampling length was set to 1000 μm. If there was some oxide scale remaining on the surface of the austenitic stainless steel material, locations where there was no oxide scale remaining were selected and measurement was performed at those locations. The arithmetic average of the measurement results obtained at the three locations was defined as the two-dimensional arithmetic average roughness Ra (μm). The results are shown in the column "Surface Roughness Ra" in Table 2. In Table 2, a case where the two-dimensional arithmetic average roughness Ra was 10 μm or less is indicated by "E (Excellent)", and a case where the two-dimensional arithmetic average roughness Ra was more than 10 μm is indicated by "A (Acceptable)".

[Solid Carburizing Test]

The carburization resistance of the austenitic stainless steel material in a high temperature environment of 650° C. or more was evaluated by the following method. One test specimen that included the inner surface was taken from the austenitic stainless steel material (steel pipe) of each test number. The size of the test specimen was approximately 4 mm in the wall thickness direction of the austenitic stainless steel pipe (t direction), 35 mm in the longitudinal direction of the austenitic stainless steel pipe (l direction), and 25 mm in the direction perpendicular to both the wall thickness direction and longitudinal direction of the austenitic stainless steel (w direction). The test specimen was embedded in a solid carburizer (KG 30.2 manufactured by H.E.F DURFERRIT JAPAN). The test specimen and solid carburizer were housed in a container made of austenitic stainless steel that had an inner diameter of 100 mm and a depth of 120 mm. The container made of austenitic stainless steel was inserted into a muffle furnace, and the temperature was raised to 850° C. and the container was held therein at that temperature for 100 hours. After the holding time elapsed, the test specimen was taken out and cut using a micro-cutter. The cut test specimen was embedded in a resin in a manner so as to make a t-w plane the observation surface. The observation surface was mirror-polished using diamond abrasive grains to thereby prepare a sample for cross-sectional analysis. The prepared sample for cross-sectional analysis was subjected to line analysis of the C concentration from the surface of the test specimen to a depth of 1000 μm using an EPMA. The analysis pitch was set to 2 μm, and the analysis beam diameter was set to 0.1 μm. The C concentration at each analysis point also included the C concentration contained in the austenitic stainless steel material before the solid carburizing test. Therefore, the C concentration contained in the molten steel of the austenitic stainless steel material was subtracted from the C concentration at each analysis point. The C concentration at each analysis point was multiplied by the analysis pitch (2 μm), the obtained values were summed, and the sum value was further divided by 1000 μm. The obtained value was evaluated as the total amount (mass %) of C that had penetrated into an area from the austenitic stainless steel material surface to a depth of 1000 μm. Hereinafter, this value is referred to as "penetrated C amount". The results are shown in Table 2. Test numbers in which the penetrated C amount was within a range of 1.0% by mass or more to less than 3.0% by mass were evaluated as having carburization resistance within an allowable range, and are indicated by "A (Acceptable)". Test numbers in which the penetrated C amount was less than 1.0% by mass were evaluated as having particularly excellent carburization resistance, and are indicated by "E (Excellent)". On the other hand, test numbers in which the penetrated C amount was 3.0% by mass or more were evaluated as having low carburization resistance, and are indicated by "NA (Not Acceptable)".

[Test Results]

Referring to Table 1 and Table 2, in each of Test Nos. 1 to 23 the chemical composition was appropriate and the production conditions were also appropriate. Test Nos. 1 to 23 satisfied Formula (1). As a result, in each of Test Nos. 1 to 23 the penetrated C amount was less than 3.0% by mass, and each of Test Nos. 1 to 23 was excellent in carburization resistance in a high temperature environment of 650° C. or more.

In addition, in Test Nos. 1 to 21 in each of which the ratio of residual oxide scale was 5% or less and the two-dimensional arithmetic average roughness Ra of the surface was 10 μm or less, the penetrated C amount was less than 1.0% by mass. In comparison to Test Nos. 22 and 23, Test Nos. 1 to 21 were further excellent in carburization resistance in a high temperature environment of 650° C. or more.

On the other hand, in Test No. 24, the solution treatment conditions did not satisfy Formula (2). Therefore, the average Nb concentration Nbs and the average Nb concentration Nbb did not satisfy Formula (1). As a result, the penetrated C amount was 3.0% by mass or more, and thus the carburization resistance was low.

In Test No. 25, the solution treatment holding time t was too short. Therefore, the average Nb concentration Nbs and the average Nb concentration Nbb did not satisfy Formula (1). As a result, the penetrated C amount was 3.0% by mass or more, and thus the carburization resistance was low.

In Test No. 26, the content of C in the austenitic stainless steel material was too high. Therefore, the penetrated C amount was 3.0% by mass or more, and thus the carburization resistance was low.

In Test No. 27, the content of Cr in the austenitic stainless steel material was too low. Therefore, the penetrated C amount was 3.0% by mass or more, and thus the carburization resistance was low.

In Test No. 28, the content of Ni in the austenitic stainless steel material was too low. Therefore, the penetrated C amount was 3.0% by mass or more, and thus the carburization resistance was low.

In Test No. 29, the content of Nb in the austenitic stainless steel material was too low. Therefore, the penetrated C amount was 3.0% by mass or more, and thus the carburization resistance was low.

An embodiment of the present disclosure has been described above. However, the embodiment described above is merely an example for carrying out the present disclosure. Therefore, the present disclosure is not limited to the above-described embodiment, and can be implemented by appropriately modifying the above embodiment within a range that does not depart from the gist of the present disclosure.

The invention claimed is:

1. An austenitic stainless steel material consisting of, in mass %,

C: 0.030% or less,
Si: 0.01 to 1.00%,
Mn: 0.01 to 2.00%,
P: 0.040% or less,
S: 0.0100% or less,
Ni: 8.00 to 18.00%,
Cr: 15.00 to 25.00%, Mo: 0.10 to 5.00%,
Nb: 0.20 to 1.00%,
N: 0.060 to 0.250%,
Cu: more than 2.00 to 4.00%,
B: 0.0010 to 0.0100%,
sol. Al: 0 to 0.100%,
Co: 0 to 1.00%,
W: 0 to 5.00%,
V: 0 to 1.00%,
Ti: 0 to 0.50%,
Ta: 0 to 0.50%,
Hf: 0 to 0.10%,
Zr: 0 to 0.10%,
Ca: 0 to 0.0200%,
Mg: 0 to 0.0200%, and
rare earth metal: 0 to 0.100%,
with the balance being Fe and impurities,
and satisfying Formula (1):

$$Nbs \times 0.8 > Nbb \quad (1)$$

where, in Formula (1), an average Nb concentration in percent by mass in an outer layer from a surface of the austenitic stainless steel material to a depth of 10 μm is substituted for Nbs, and an average Nb concentration in percent by mass in a region excluding the outer layer of the austenitic stainless steel material is substituted for Nbb.

2. The austenitic stainless steel material according to claim 1, wherein, a content of at least one element selected from a group consisting of sol, Al, Co, W, V, Ti, Ta, Hf, Zr, Ca, Mg, and rare earth metal (REM) is, in mass %, sol. Al: 0.001 to 0.100%,
Co: 0.01 to 1.00%,
W: 0.01 to 5.00%,
V: 0.01 to 1.00%,
Ti: 0.01 to 0.50%,
Ta: 0.01 to 0.50%,
Hf: 0.01 to 0.10%,
Zr: 0.01 to 0.10%,
Ca: 0.0001 to 0.0200%,
Mg: 0.0001 to 0.0200%, and
rare earth metal (REM): 0.001 to 0.100%.

3. The austenitic stainless steel material according to claim 1, wherein:

an area fraction of residual oxide scale on the surface of the austenitic stainless steel material is 5% or less, and a two-dimensional arithmetic average roughness Ra of the surface of the austenitic stainless steel material is 10 μm or less.

4. The austenitic stainless steel material according to claim 2, wherein:

an area fraction of residual oxide scale on the surface of the austenitic stainless steel material is 5% or less, and a two-dimensional arithmetic average roughness Ra of the surface of the austenitic stainless steel material is 10 μm or less.

* * * * *